US009809436B2

(12) United States Patent
Clüsserath

(10) Patent No.: US 9,809,436 B2
(45) Date of Patent: Nov. 7, 2017

(54) FILLING SYSTEM AND METHOD FOR THE TREATMENT OF CONTAINERS WITH A PROCESS GAS

(71) Applicant: KHS GmbH, Dortmund (DE)

(72) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 111 days.

(21) Appl. No.: 14/904,225

(22) PCT Filed: Jul. 3, 2014

(86) PCT No.: PCT/EP2014/064200
§ 371 (c)(1),
(2) Date: Jan. 11, 2016

(87) PCT Pub. No.: WO2015/004001
PCT Pub. Date: Jan. 15, 2015

(65) Prior Publication Data

US 2016/0152458 A1 Jun. 2, 2016

(30) Foreign Application Priority Data

Jul. 9, 2013 (DE) ..... 10 2013 107 256

(51) Int. Cl.
*B67C 3/10* (2006.01)
*B67C 3/26* (2006.01)

(52) U.S. Cl.
CPC ..... *B67C 3/10* (2013.01); *B67C 3/2628* (2013.01); *B67C 2003/2602* (2013.01)

(58) Field of Classification Search
CPC .. B67C 3/10; B67C 3/2628; B67C 2003/2602
USPC ..... 141/57
See application file for complete search history.

(56) References Cited

U.S. PATENT DOCUMENTS 4,363,339 A 12/1982 Puskarz
6,155,314 A * 12/2000 Ding ..... B67C 3/2617 141/192
6,189,578 B1 * 2/2001 Clusserath ..... B67C 3/10 141/293

(Continued)

FOREIGN PATENT DOCUMENTS

DE 75 36 390 4/1976
DE 25 47 187 4/1977

(Continued)

*Primary Examiner* — Timothy L Maust
(74) *Attorney, Agent, or Firm* — Occhiuti & Rohlicek LLP

(57) ABSTRACT

A filling element includes an actuator, a liquid valve, and a gas tube on a plunger that extends into a container. The plunger and the gas tube define a first gas-duct that extends through the plunger and the gas tube. The first gas-duct has ends that extend respectively into a gas-space of a product vessel and the container's interior. A first gas-valve along the first gas-duct has a gas-valve body that interacts with a valve seat in the first gas-duct. The gas-valve body has a second gas-duct formed therethrough. This second gas-duct at least temporarily engages the first gas-duct in a fluid-tight manner. The gas-valve body has a valve face and a valve opening that cooperate to form a second gas-valve through which, when the second gas-valve opens, gas flows through the first and second gas-ducts and enters the container.

27 Claims, 10 Drawing Sheets

(56) References Cited

U.S. PATENT DOCUMENTS

| | | | | |
|---|---|---|---|---|
| 7,353,848 | B2 * | 4/2008 | Krulitsch | B67C 3/06 141/146 |
| 7,647,950 | B2 * | 1/2010 | Clusserath | B67C 3/2628 141/44 |
| 9,067,698 | B2 * | 6/2015 | Stolte | B08B 9/0813 |
| 9,181,074 | B2 * | 11/2015 | Clusserath | B67C 3/10 |
| 2013/0180619 | A1 * | 7/2013 | Clusserath | B67C 3/06 141/6 |
| 2015/0284233 | A1 * | 10/2015 | Meinzinger | B67C 3/10 141/6 |
| 2016/0115009 | A1 * | 4/2016 | Clusserath | B67C 3/2617 141/65 |
| 2016/0152458 | A1 * | 6/2016 | Clusserath | B67C 3/10 53/432 |
| 2016/0214845 | A1 * | 7/2016 | Clusserath | B67C 3/10 |

FOREIGN PATENT DOCUMENTS

| | | |
|---|---|---|
| DE | 43 11 202 | 10/1994 |
| DE | 10 2010 022 985 | 12/2011 |
| EP | 0 953 542 | 11/1999 |
| EP | 10 2009 009339 | 8/2010 |

* cited by examiner

FILLING SYSTEM AND METHOD FOR THE TREATMENT OF CONTAINERS WITH A PROCESS GAS

RELATED APPLICATIONS

This is the national stage of PCT/EP2014/064200, filed on Jul. 3, 2014, which claims the benefit of the Jul. 9, 2013 priority date of DE 102013107256.9, the contents of which are herein incorporated by reference.

FIELD OF INVENTION

The invention relates to processing containers, and in particular, to container filling.

BACKGROUND

The process of mass-producing containers that contain liquid includes far more than simply placing a container under a spigot and allowing liquid to flow into it. In known filling systems, the container must be purged of any ambient air. This is because oxygen in the air may be detrimental to long-term storage of the beverage. In some cases, depending on the nature of the container, the container must be pre-tensioned before filling. Finally, during the filling itself, the incoming liquid displaces whatever gas happens to be in a container. Thus, there must be some way to dispose of this gas while the liquid actually flows into the container. Finally, the filling element must place the correct amount of liquid in each container.

A filling element must therefore be able to do more than just turn a spigot on and off. It must manage the various gas flows that are required during filling. These gas flows have different requirements. Known filling elements face difficulty in controlling these sometimes contradictory demands without considerable complexity.

Additionally, the various gases that are used during this process are not without cost. Known filling elements tend to behave as if this were not the case. As a result, copious amounts of various process gases are used up. This drives up the cost of filling containers.

SUMMARY

An object of the invention is to provide a filling system and a method for treatment of containers with a process gas that facilitates a particularly effective purging of the container's interior with a minimal consumption of purging gas.

In one aspect, the invention relates to a filling system for filling bottles or similar containers with a liquid product. The filling system includes a product vessel in which, during filling, a lower liquid space occupied by the product and above it a gas space are formed. The filling system also has at least one filling element arranged below the product vessel.

The filling element has a filling-element housing in which is configured a liquid duct that connects to the liquid space and that forms a product dispensing opening at an underside of the filling-element housing. This underside is the side that faces away from the product vessel.

A liquid valve arranged in the liquid duct has a valve body, provided on a valve plunger arranged coaxially with a filling element axis. The valve body moves axially for opening and closing the liquid valve and for a controlled release of the product.

A first gas-duct is formed in the valve plunger. At its upper end, the first gas-duct opens into the gas space of the product vessel. At its lower end, it opens into a headspace of the container. A first gas-valve in the first gas-duct has a gas-valve body that is movable for opening and closing the first gas-valve. At least one actuator interacts with the first gas-valve's gas-valve body.

The gas-valve body has a second gas-duct that can at least temporarily make a fluid-tight connection with the first gas-duct. The gas-valve body can thus create a second gas-valve for charging the container's interior with a process gas at a volumetric flow-rate that is lower than that which occurs upon opening the first gas-valve. As a result, the second gas-duct, having been configured as a gas-valve body, permits multi-stage charging of the container with a process gas, with the volumetric flow of the gas fed into the container's interior being different in the different stages.

In some embodiments, the second gas-duct has a cross-section that is smaller than that of the first gas-duct, thus restricting the volumetric flow of process gas through the reduced cross-section in the second gas-duct.

In some embodiments, a restrictor in the second gas-duct reduces flow of gas through that duct. The volumetric flow through the second gas-duct, and hence the volumetric flow of process gas introduced into the container, can be further reduced as a result. The restrictor preferably defines a bore with a diameter of 0.5-2.0 mm that extends along the flow direction by 0.3-1.0 mm.

In some embodiments, the gas-valve body comprises an opening that is arranged in the gas space to form a second gas-valve. When the second gas-valve opens, gas flows through the first and second gas-duct into the container present at the filling element.

In other embodiments, the second gas-duct and the first gas-duct, which is configured in the valve plunger, form a fluid-tight connection with each other. This makes it possible to control the supply of process gas present in the gas space via the second gas-duct, the first gas-duct, and a gas tube extending into the headspace of the container by opening and/or closing the second gas-valve. This, in turn, makes it possible to purge the container with a reduced supply of process gas from the gas space.

In some practices of the invention, the purging operation is carried out in two successive process steps. The first process step is to connect the container's interior to a vacuum source, thus evacuating the container's interior. The second process step is to actually purge the container by blowing in the purging gas.

In other practices, during the purging operation, the container's interior remains connected to the vacuum source so that purging gas being blown into the container's interior faces only a vacuum, and thus meets with little resistance as it flows. For example, in some practices, the evacuation of the container in the first process step of purging occurs in such a way that a pressure of around 0.05-0.4 bar arises in the container. In other practices, the pressure in the container is around 0.05-0.25 bar. In other practices, there is a vacuum of around 0.6 bar to 0.95 bar. In yet other practices, the vacuum is 0.75-0.95 bar compared with ambient pressure.

In some practices, introducing purging gas includes restricting the volumetric flow in the second gas-duct or the pressure present in the gas space in such a way that there is at most a minimal pressure increase in the container's interior. Some practices include keeping this pressure increase as low as of 0.05 bar to 0.2 bar.

Some embodiments are controlled to keep the connection with the vacuum source open for a certain period of time after the supply of purging gas has been closed so as to restore the original vacuum in the container. This is by no means essential however.

In some embodiments, a partial stroke of the actuator opens or closes the opening. Preferably, only the second gas-valve opens while the first gas-valve remains closed, i.e. the second gas-duct is connected to the first gas-duct in a fluid-tight manner. A first partial-stroke by the actuator can thus purge the container's interior with a process gas at a restricted volumetric flow.

In some embodiments, the gas-valve body can move on the axis of the filling element to open and close the first gas-valve, interacting with a valve face configured in the first gas-duct. In other words, to open the first gas-valve, the actuator raises the gas-valve body along the filling-element axis so that the seal seat of the gas-valve body is lifted off the bore provided in the valve plunger or off the valve seat that is provided there. Conversely, to close the first gas-valve, the actuator lowers the gas-valve body along the filling element axis to achieve a seal seat between the gas-valve body and the valve seat configured in the valve plunger.

A second partial-stroke of the actuator moves the gas-valve body. This second partial-stroke is coaxial with the first. In this way, it is possible for one actuator to actuate both the first and second gas-valves provided the actuator can carry out the required two-stage stroke movement.

In some embodiments, the first gas-valve facilitate a greater gas flow per unit of time than the second gas-valve. Thus, opening the second gas-valve results in a volumetric flow rate into the container's interior than that which would result by opening the first gas-valve.

In one embodiment, the first gas-valve's body is accommodated for part of its length in the first gas-duct out of which it projects by an upper end. Among these embodiments are those in which it interacts by its upper end with the actuator. The first gas-duct can be configured in an incremental manner, with it being extended incrementally upwards by the increment. An upper region of the first gas-duct can thus at least partially accommodate the gas-valve body.

In another embodiment, the opening in the gas-valve body that forms the second gas-valve is provided on a partial length that projects beyond the first gas-duct, in particular on the upper end face of the gas-valve body. In this embodiment, a section of the actuator, or an element provided thereon, opens and closes the opening of the second gas-valve.

In some embodiments, two coaxial lifting-elements form the actuator. These lifting elements can be implemented by piston-cylinder arrangements.

A first lifting-element acts through a plunger and an adapter on the gas-valve body; whereas a second lifting element forms a stop for the stroke movement of the first lifting element. In a first state of the second lifting-element, the stop limits the stroke of the first lifting-element to a first partial-stroke. In a second state of the second lifting-element, a second partial-stroke lifts the second lifting-element so as to increase the extent of the total stroke of the first lifting-element to the sum of the extends of the first and second partial-strokes. This results in a two-stage stroke movement of the plunger with only the second gas-valve being opened on the first partial stroke but with the first gas-valve also being opened on completion of the further second partial-stroke that follows the first partial-stroke.

In one embodiment, when the lifting element is in the lowered state the adapter brings about a sealing of the opening and hence a closing of the second gas-valve. The adapter preferably comprises a surface section that, in the lowered state of the first lifting-element, presses on a seal or sealing face provided at the opening so as to close the second gas-valve.

When the lifting element is raised by the first partial stroke, the adapter, and more particularly the surface section of the adapter that brings about the closing, is preferably lifted clear of the opening. This opens the second gas-valve. The first gas-valve on the other hand remains closed because the gas-valve body is still lowered. On completion of the first partial-stroke therefore the second gas-valve can be opened through the multi-stage stroke movement of the actuator by separating the adapter's seal seat from the gas-valve body.

In some embodiments, the adapter includes a first control-surface that. During the first partial-stroke, the first control-surface does not come to rest on the gas-valve body. During the second partial stroke of the lifting element, the gas-valve body partly rests on the first control-surface so as to lift the gas-valve body out of the sealed position of the valve face configured in the first gas-duct.

More particularly, the adapter has a hook-shaped section that engages behind a projection of the gas-valve body, also referred to as a control section hereinafter. The first control-surface, which rests on the projection of the gas-valve body during the second partial-stroke, and which thus raises the gas-valve body when the plunger moves upward, is provided on this hook-shaped section. Because the first control-surface does not rest on the gas-valve body during the first partial-stroke, the surface section of the adapter that seals the opening of the second gas-valve is lifted clear of the opening of the gas-valve body. However, during this first partial stroke, the gas-valve body has yet to be lifted. Accordingly, the first gas-valve has yet to open.

In some embodiments, the adapter has a second control-surface that interacts with the valve plunger to close the liquid valve. The second control-surface is a surface lying opposite the first control-surface on the hook-shaped section of the adapter. Using this second control-surface, the adapter acts on the top of the valve plunger, for example on a flange-like projection thereof. This means that when the actuator returns to its initial position, in which the plunger is fully extended into the vessel, the valve body presses against the valve seat. This closes the liquid valve. The actuator therefore advantageously not only actuates the first or second gas-valve but also actively closes the liquid valve.

In another embodiment the liquid valve comprises an opening spring that pre-tensions the liquid valve in its open state. This opening spring, which is more particularly configured as a compression spring, has a spring constant selected such that when the container's internal pressure reaches a certain pre-tensioning pressure, the opening spring's force overcomes the weight of the valve body or valve plunger and of the column of liquid weighing down on the valve body, less friction forces. This automatically opens the liquid valve without the intervention of any other actively operated drive.

The second gas-duct can be connected at least temporarily with a further gas space that is independent of the product vessel's gas space. This is effected, for example, by way of a gas duct provided in the plunger of the actuating device that establishes a connection with the further gas space, for example, via at least one further line and, if necessary, at least one valve.

More particularly, the second gas-duct can be configured so that it can be connected with the gas space for purging the container to be filled, and with the further gas space for pre-tensioning the container. In this way it is possible that the pre-tensioning process and the purging to be carried out with different gases. This means that pre-tensioning can be carried out with a less expensive process gas.

The invention also relates to a method for the treatment of containers with a process gas prior to filling, using a filling element at which the respective container is present in sealed position during the treatment and through which a process gas is introduced into the container and through which a process gas and a gaseous and/or vaporous medium displaced from the container, for example air, is discharged from the container; before a process gas is introduced the container is evacuated or charged with the vacuum of a vacuum source; the filling element comprises a first gas-duct that, at an upper end, issues into the gas space of the product vessel and at the lower end into a headspace of the container arranged at the filling element; a first gas-valve having a gas-valve body that can be moved to open and close the first gas-valve is provided in the first gas-duct. After the container has been charged with the vacuum, a first process gas for purging the container is introduced by the opening of a second gas-valve via a second gas-duct that is configured in the gas-valve body, is at least temporarily connected with the first gas-duct in a fluid-tight manner and that comprises the second gas-valve; the container remains connected to the vacuum source during purging. Once the container has been purged, the first gas-valve is opened to effect a pre-tensioning of the container with a second process gas; the volumetric flow of this second process gas through the first gas-valve during the pre-tensioning of the container is greater than the volumetric flow of the first process gas through the second gas-valve during the purging of the container.

The first process gas can be the same as the second process gas here, but the use of different process gases is preferable.

In a preferred embodiment the volumetric flow of the first process gas introduced into the container during purging, and the vacuum of the vacuum source, are selected so that in the case of the first process gas flowing through the container's interior, a purging pressure inside the container that is equal to or slightly above or below ambient pressure is obtained. This achieves an effective purging of the bottle's interior while significantly reducing the consumption of purging gas and consequently a significant cost saving.

More particularly, the pressure and/or volumetric flow of the first process gas and the pressure of the vacuum source can be selected to obtain a purging pressure of between 0.05 bar and 0.45 bar, these being absolute values. An especially effective purging process is achieved with a purging pressure set in this way.

In a preferred embodiment, in a first process step the container is evacuated to a pressure ranging between 0.05 bar and 0.2 bar, and in a second, subsequent process step the first process gas is introduced or blown into the container and preferably in such a way that the pressure inside the container is not increased by the introduction or blowing-in of the first process gas or is increased only minimally, say by 0.05 bar-0.2 bar.

It is especially preferable if the first process gas for purging the container is introduced via a second restrictor provided in the gas duct. The restrictor preferably has a bore with a diameter of 0.5-2.0 mm for a thickness of the restrictor in the direction of flow of the gas of 0.3 mm-1 mm.

In an alternative embodiment, a first partial-stroke of the actuator that interacts with the gas-valve body opens and closes the second gas-valve. In this embodiment, the actuator raises or lowers the gas-valve body to open and close the first gas-valve.

In another aspect, the invention features an apparatus for filling containers with liquid product. Such an apparatus includes a product vessel and a filling element arranged below the product vessel. When the apparatus is operating, liquid product partially fills the product vessel, thus defining a liquid space occupied by the filling product and a first gas-space above the liquid space. The filling element includes a filling-element housing having a liquid duct formed therein to connect the liquid space, and a dispensing opening disposed on an underside of the filling-element housing facing away from the product vessel. The filling element also includes a liquid valve having a valve plunger aligned coaxially with a filling-element axis, and a liquid-valve body provided on the valve plunger. The liquid-valve body is movable along the filling-element axis to open and close the liquid valve. The filling element also includes an actuator and a gas tube provided on the valve plunger. In operation, the gas tube extends into a headspace of a container that is arranged to be filled at the filling element. The valve plunger and the gas tube cooperate to define a first gas-duct that extends through the valve plunger and through the gas tube. The first gas-duct has an upper end that extends into the first gas-space of the product vessel and a lower end that opens into an interior of the container. Along the first gas-duct is a first gas-valve having a gas-valve body that interacts with a valve seat configured in the first gas-duct. This first gas-valve transitions between an open and closed state in response to the actuator. The gas-valve body includes a second gas-duct formed through it. This second gas-duct at least temporarily engages the first gas-duct in a fluid-tight manner. The gas-valve body includes a valve face and a valve opening that cooperate to form a second gas-valve that, when open, allows a flow of gas through the first and second gas-ducts to enter the container.

Embodiments include those in which the gas-valve body is configured as a hollow needle.

Other embodiments include those in which the cross-section of the second gas-duct is smaller than that of the first gas-duct, as well as those that include a restrictor in the second-gas duct to reduce volumetric gas flow through the second gas-duct.

Further embodiments include those in which the actuator opens or closes the valve's opening by executing a first partial-stroke, a length of which is restricted by an obstruction to travel.

In some embodiments, the gas-valve body is movable along the filling element axis for opening and closing the first gas-valve by interacting with a valve face in the first gas-duct. Among these are embodiments in which the actuator moves the gas-valve body along first and second coaxial partial-strokes.

Also among the embodiments are those in which opening the first gas-valve causes a greater gas flow rate than opening the second gas-valve.

In yet other embodiments, the first gas-duct accommodates part of a length of the gas-valve body of the first gas-valve. In these embodiments, the gas-valve body includes an upper end that projects out of the first gas-duct. This upper end interacts the actuator. Among these embodiments are those in which the valve opening of the gas-valve body is provided on an upper end face of the gas-valve body and projects beyond the first gas-duct.

Some embodiments also have a plunger and an adapter. In these embodiments, the actuator includes first and second lifting-elements that are coaxial with the filling-element axis. The first lifting-element acts through the plunger and the adaptor on the gas-valve body. The second lifting-element forms a stop for a stroke of the first lifting-element. The second lifting-element transitions between first and second states. In the first state, the stroke is limited to a first partial-stroke; in the second state, the second lifting-element is raised by a second partial-stroke such that the stroke of the first lifting-element has a length that increases to a sum of the first and second partial strokes. Among these embodiments are those in which the adapter seals the opening and closes the second gas-valve when the first lifting-element is in a lowered state. Also among these embodiments are those in which, when the first lifting-element is in a raised state, the adapter is lifted off the opening, and the second gas-valve opens. Also among these embodiments are those in which the adapter includes an adapter surface that interacts with the plunger for closing the liquid valve.

Some embodiments include an adapter with a hooking surface. In these embodiments, during the first partial-stroke, the hooking surface remains separated from the gas-valve body. But in the second partial-stroke, the hooking surface engages the gas-valve body so as to raise the gas-valve body out of the sealed position of the valve face in the first gas-duct.

Additional embodiments include a spring that pre-tensions the liquid valve into an open state thereof.

Some embodiments include a second gas-space that is independent of the first gas-space. In these embodiments, the second gas-duct connects at least temporarily to the second gas space. Among these embodiments are those in which the second gas-duct transitions between a first state for purging the container and a second state for pre-tensioning the container. In the first state, the second gas-duct connects to the first gas-space; and in the second state, the second gas-duct connects to the second gas space.

In another aspect, the invention features a method for treating a container with a gas prior to filling the container using a filling element against which the container is sealed during treatment, through which gas is introduced into the container, and through which gas displaced from the container passes through. The filling element includes a first gas-duct that opens, at an upper end thereof, into a gas-space of a product vessel and that opens, at a lower end thereof, into a headspace of the container. The first gas-duct has a gas-valve body that is movable to open and close a first gas-valve and in which a second gas-duct is configured. The second gas-duct is connected at least temporarily with the first gas-duct in a fluid-tight manner. The method includes, before pre-tensioning the container with a first process gas stored in the gas space, evacuating the container with a vacuum provided by a vacuum source, opening a first gas-valve to pre-tension the container with the first process gas, the first process gas flowing at a pre-tensioning volumetric flow rate, and, with the container still connected to the vacuum source, opening a second gas-valve to introduce a second process gas for purging the container through the second gas-duct, the second process gas flowing at a purging volumetric flow rate, wherein the purging volumetric flow rate is less than the pre-tensioning volumetric flow rate.

In some practices, the first process gas and the second process gas are the same gas, whereas in others, they are different gases.

Other practices include selecting the purging volumetric flow rate and the vacuum such that when the second process-gas flows into the container's interior, the interior is maintained at a purging pressure that is within a pre-set tolerance around ambient pressure.

In some practices, the purging pressure is within 0.1 bar and 0.45 bar of ambient pressure.

In other practices, evacuating the container includes evacuating to a pressure ranging between 0.05 bar and 0.2 bar in a first process step, and in a second, subsequent process step introducing the second process gas into the container in such a way that pressure in the container increases by less 0.2 bar.

Yet other practices include passing the second process gas through a restrictor provided in the second gas-duct. Among these are practices in which the restrictor includes a bore with a diameter of 0.3-1 mm for a restrictor length in the direction of flow of the gas of 0.5 mm.

Alternative practices include those in which opening a second gas-valve includes causing an actuator to execute a first partial-stroke that results in an interaction the gas-valve body, and those in which opening a first gas-valve to pre-tension the container with the first process gas includes causing an actuator to move the gas-valve body.

In yet another aspect, the invention features a filling element that includes an actuator, a liquid valve, and a gas tube on a plunger that extends into a container. The plunger and the gas tube define a first gas-duct that extends through the plunger and the gas tube. The first gas-duct has ends that extend respectively into a gas-space of a product vessel and the container's interior. A first gas-valve along the first gas-duct has a gas-valve body that interacts with a valve seat in the first gas-duct. The gas-valve body has a second gas-duct formed through it. This second gas-duct at least temporarily engages the first gas-duct in a fluid-tight manner. The gas-valve body has a valve face and a valve opening that cooperate to form a second gas-valve through which, when the second gas-valve opens, gas flows through the first and second gas-ducts and enters the container.

As used herein, references to a container sealed against a filling element refer to a container that lies with a mouth thereof pressed tightly against the filling element or against a seal located at the filling element in a way that isolates the container's interior from the atmosphere.

As used herein, the term "containers" refers to cans and bottles, whether made of metal, glass, plastic, and combinations thereof.

As used herein, the expressions "essentially," "in essence," and "around" mean variations from the respective exact value by ±10%, preferably by ±5% and/or variations in the form of changes insignificant for the function.

Further embodiments, advantages, and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

BRIEF DESCRIPTION OF THE FIGURES

These and other features of the invention will be apparent from the following detailed description and the accompanying figures, in which:

FIG. 7 shows a vertical section of the filling element as it depressurizes a container;

DETAILED DESCRIPTION

Figure 1:
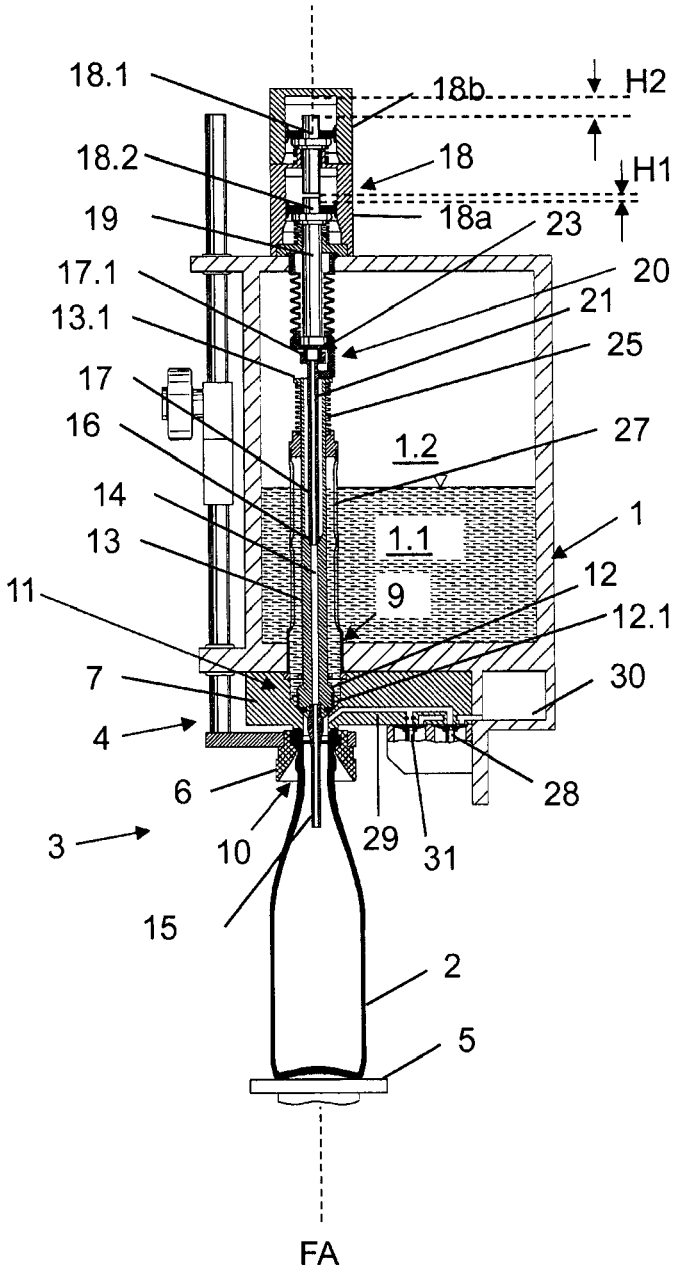
FIG. 1 shows a vertical section of a filling element.

FIG. 1 shows a cross-section of a filling position 3 formed on the periphery of a rotor of a rotary single-chamber filling machine for filling containers 2 with liquid filling-product. The rotor is drivable to rotate about a vertical machine axis. In the illustrated embodiment, the containers 2 happen to be bottles. However, other containers are possible.

Part of the rotor includes an annular vessel 1 for holding the liquid filling-product. In operation, the liquid filling-product partially fills the annular vessel 1 to some controlled level. This level divides the annular vessel 1 into a lower liquid space 1.1 occupied by the product and, above it, a first gas-space 1.2 filled, for example, with an inert gas such as $CO_2$ gas, nitrogen, or sterile air.

The filling position 3 is one of a multiplicity of identical filling positions formed on an underside of the annular vessel 1. A fixed angle separates each filling position from its neighboring filling position. Each filling position has a filling element 4 and a container carrier 5. During filling, a container 2 stands upright on its base on the carrier 5 with its mouth pressed tightly against a ring seal of a centering tulip 6.

In the illustrated embodiment, each filling element 4 has a flat, plate-like filling-element housing 7. A liquid duct 8 passes through the filling-element housing 7. One end of the duct 8 connects to the liquid space 1.1 through a vessel opening 9 in the base of product vessel 1. The other end forms a product-dispensing opening 10 that is surrounded by the ring seal and through which the product flows to the container 2 during filling.

Within the duct 8, a liquid valve 11 controls the release of liquid product to the container 2. The liquid valve 11 includes a liquid-valve body 12. When the liquid valve closes, the liquid-valve body 12 rests against a valve seat formed within the liquid duct 8. A tubular valve plunger 13 arranged coaxially with a vertical filling element axis FA moves the liquid-valve body 12 up and down along the filling element axis FA to open and close the liquid valve 11. A radially extending upper portion of the plunger 13 defines a plunger flange 13.1.

A first gas-duct 14 passes through the valve plunger 13 and continues on into a gas tube 15. During operation of the filling element 4, with a container 2 sealed against the filling element 4, the gas tube 15 extends through the container's mouth and into a headspace of the container 2. The gas tube's lower end forms the lower opening of first gas-duct 14.

A first gas-valve 16 along an upper portion of the first gas-duct 14 has a hollow needle-shaped gas-valve body 17 that is coaxial with filling element axis FA. Raising the gas-valve body 17 relative to the valve plunger 13 opens the first gas-valve 16; lowering it relative to the valve plunger 13 closes the first gas-valve 16.

When the first gas-valve 16 closes, a valve face at the lower end of the gas-valve body 17 rests against a valve seat formed in first gas-duct 14. The gas-valve body 17 has an outer cross-section that is selected so that the gas duct 14, surrounding the gas-valve body 17 at a distance therefrom, extends as far as an upper open end of the valve plunger 13.

A second gas-duct 21 coaxial with the first gas-duct 14 passes through the full length of what is, as a result, a tubular gas-valve body 17. Upon opening of the first gas-valve 16, the lower free end of the second gas-duct 21 thus connects to the first gas-duct 14 in a fluid-tight manner. The upper end of the first gas-duct 14 defines a second gas-valve 23.

An actuator 18 controls both the first gas-valve 16 and the second gas-valve 23. In some embodiments, the actuator 18 is a pneumatic actuator on top of, and preferably outside of, the vessel 1. The actuator 18 acts on the upper end of gas-valve body 17 through a plunger 19 arranged coaxially with filling element axis FA and an adapter 20 coupled to the plunger 19. Since the plunger 19 passes through the vessel 1 in the process, it is useful to provide a bellows to prevent contamination of the vessel 1.

To facilitate interaction with the plunger 19, an upper end of the gas-valve body 17 includes a control section implemented as a gas-valve collar 17.1 that extends the gas-valve body 17 radially outwards at its upper free end so as to configure an external ledge of the gas-valve body 17.

Through electro-pneumatic control valves, the actuator 18 causes controlled two-stage axial movement of the plunger 19 and hence of the adapter 20 along the filling element axis FA. To carry this out, the actuator 18 includes an upper piston-cylinder arrangement **18*b* and a lower piston-cylinder arrangement 18*a*** that form corresponding pneumatic lifting elements.

The lower piston-cylinder arrangement **18*a* includes a lower piston 18.2 that acts directly on the plunger 19. In effect, the plunger 19 can be viewed as a piston rod of the lower piston-cylinder arrangement 18*a***.

The upper piston-cylinder arrangement **18*b* has an upper piston 18.1 provided on another piston rod that is also coaxial with the filling element axis FA. A bellows seal seals off the region in which the plunger 19 penetrates the top of the product vessel 1**.

The actuator 18 causes the upper piston-cylinder arrangement **18*b* to execute an upper partial-stroke H2. This upper partial stroke H2 causes the upper piston-cylinder arrangement 18*b*** to transition between an upper position and a lower position.

When the upper piston-cylinder arrangement **18*b* is in its lower position, its piston rod forms a stop for the piston rod of the lower piston-cylinder arrangement 18*a*. This stop limits the travel of the lower piston-cylinder arrangement 18*a* to a lower partial-stroke H1**.

On the other hand, when in its upper position, the upper piston-cylinder arrangement **18*b* permits the lower piston-cylinder arrangement 18*a* to execute a longer lower stroke. This longer lower stroke has a length that is equal to the sum of the lengths of the upper partial-stroke H2 and the lower partial-stroke H1**.

Figure 3:
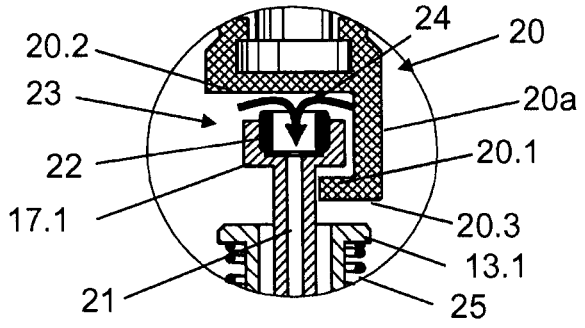
FIG. 3 shows the second gas-valve of the filling element of FIG. 1.

Referring to FIG. 3, the adapter 20 includes a hook **20*a* having a hooking surface 20.1 and a pushing surface 20.3 that are parallel to each other and that face in opposite directions. The hooking surface 20.1 faces upward towards the gas-valve collar 17.1 with which it interacts as described below. The pushing surface 20.3 faces downward, away from the gas-valve collar 17.1**

As the hook 20*a* moves upward, the hooking surface 20.1 engages the gas-valve collar 17.1. It does so by hooking the gas-valve collar 17.1 from below. In particular, the gas-valve collar 17.1 has first and second surfaces extending along a plane perpendicular to the filling-element axis FA with the second surface being closer to the container than the first surface. The hook 20*a*, and in particular, the hooking surface 20.1 thereof, engages the second surface.

The adapter 20 also has an adapter surface 20.2 that interacts with a sealing face at an opening 24 provided on the top of the gas-valve body 17. This interaction configures the second gas-valve 23.

When the adapter surface 20.2 rests against the sealing face at the opening 24, the hooking surface 20.1 is offset from the gas-valve collar 17.1 along the filling-element axis FA. For reasons that will be apparent, the offset between the hooking surface 20.1 and the adapter surface 20.2 should be equal to or greater than an extent of the lower partial-stroke H1.

The lower partial-stroke H1 raises the plunger 19, thus lifting the adapter surface 20.2 off the sealing face of opening 24 and opening the second gas-valve 23. It also raises the hooking surface 20.1 by the same amount. However, as a result of having correctly chosen the offset, even after having been raised, the hooking surface 20.1 is still at some distance away from, or at best, just barely contacts, the gas-valve collar 17.1. This means that the plunger 19 does not lift the gas-valve body 17. Therefore, the lower partial-stroke H1 opens only the second gas-valve 23 and not the first gas-valve 16.

When the plunger 19 is in its lowest position, so that as much of it as possible extends into the vessel 1, the adapter surface 20.2 of the adapter 2 lies opposite the seal provided at the opening 24. This closes the second gas-valve 23. In addition, the gas-valve body 17 is now fully pushed into the first gas-duct 14. This, in turn, closes the first gas-valve 16 and causes the second gas-duct 21 to connect to the first gas-duct 14 in a fluid-tight manner.

When the piston rod of the upper piston-cylinder arrangement 18*b* is positioned in its lower position, actuating the lower piston-cylinder arrangement 18*a* raises the plunger 19, and with it, the adapter 20, by an extent of the lower partial-stroke H1. As a result, the adapter surface 20.2 lifts off the opening 24, and the second gas-valve 23 opens. Because the opening 24 opens into the first gas-space 1.2, some of the gas in the first gas-space 1.2 flows through the opening 24, through the second gas-duct 21, through the first gas-duct 14, through the gas tube 15, and finally, into the container's headspace.

Preferably, the second gas-duct 21 has a smaller cross-section than the first gas-duct 14 so as to restrict the flow of gas from the first gas-space 1.2 into the container 2. Further restriction of this flow can be carried out with a suitable restrictor in the region of the opening 24.

Raising the piston rod of the upper piston-cylinder arrangement 18*b* into its upper position removes the restriction that the plunger 19 can only be lifted by the extent of the lower partial-stroke H1. With the upper piston-cylinder arrangement 18*b* thus raised, the lower piston-cylinder arrangement 18*a* can now lift the plunger 19 by a length that is equal to the sum of the extents of the lower partial-stroke H1 and the upper partial-stroke H2. This is enough to not only cause the hooking surface 20.1 to engage behind the gas-valve collar 17.1, but to enable the hook 20*a* to pull the gas-valve body 17 upwards at least partially out of the first gas-duct 14 and thereby opening the first gas-valve 16.

A spring 25 inside the vessel 1 acts between the plunger flange 13.1 and a tube 27 that defines a space that surrounds the valve plunger 13 to form a product inlet. In the illustrated embodiment, the spring is a compression spring oriented such that application of a force vector oriented along the filling-machine axis FA will cause the spring 25 to exert a restoring force in a direction opposite to the applied force. The spring 25 ultimately opens the liquid valve 11 in the manner described below.

FIG. 1 shows the filling element 4 and the actuator 18 in a first operating state in which the liquid valve 11, the first gas-valve 16, and the second gas-valve 23 are all closed. The container carrier 5 presses a container 2 against the ring seal in the region of the centering tulip 6. As a result, the container 2 is sealed against the filling element 4.

A vacuum control-valve 28 disposed along a vacuum duct 29 in the filling-element housing 7 selectively connects a vacuum source 30 to the container's interior. The vacuum source 30 and the vacuum control-valve 28 are preferably activated in such a way that results in a pressure of 0.05-0.25 bar within the container's interior. In some embodiments, the vacuum source 30 evacuates the container 2 to a 95% vacuum.

Figure 2:
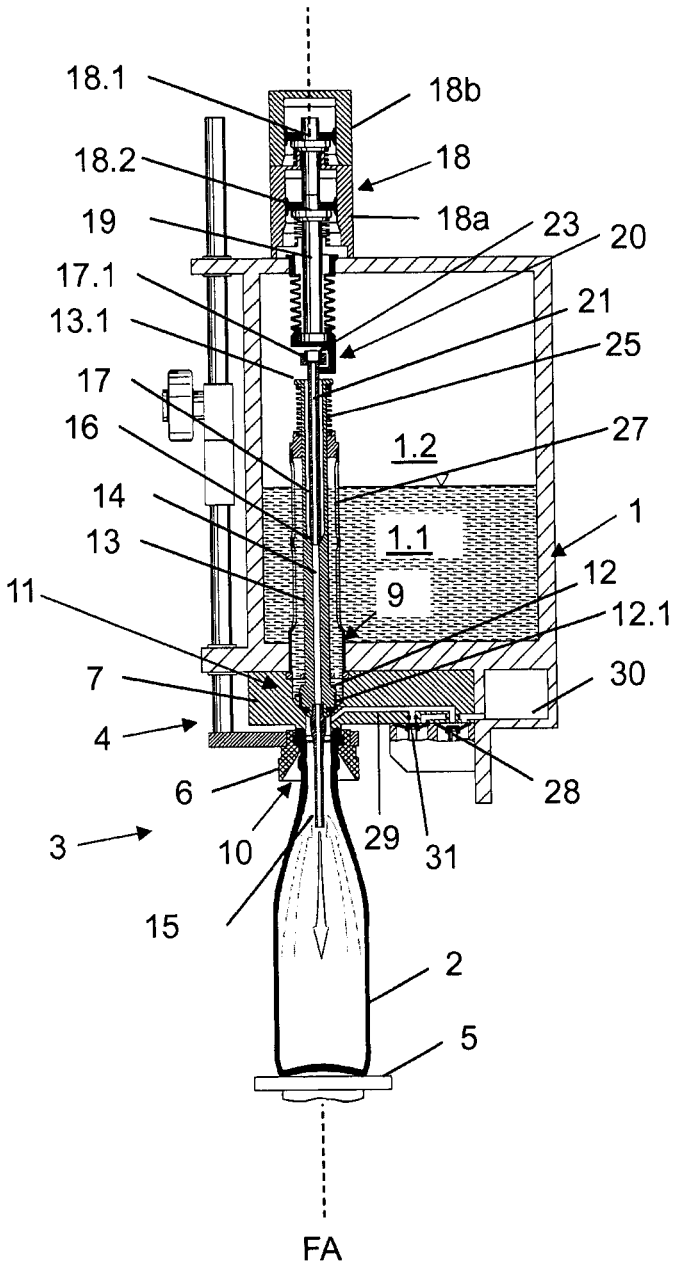
FIG. 2 shows a vertical section of the filling element of FIG. 1 during container purging.

FIGS. 2 and 3 show the second gas-valve 23 after the actuator 18 has lifted the plunger 19 by a lower partial-stroke H1, thus lifting the adapter surface 20.2 off the opening 24 and establishing a continuous gas duct between the vessel's first gas-space 1.2 and the container's interior through the opening 24, the second gas-duct 21, the first gas-duct 14, which is connected in a fluid-tight manner with second gas-duct 21, and the gas tube 15. This introduces inert gas, such as $CO_2$, from the first gas-space 1.2 into the container 2, thus purging the container 2. In the process of purging, the inert gas displaces the air in the container 4. This displaced air exits via the vacuum duct 29. The result is an especially intensive and effective purging of the container's interior.

Because the gas tube 15 extends far down into the interior of container 2, the purging gas that exits the gas tube 15 travels as far as the bottom of container 2. Meanwhile, because of the reduced-cross section of the second gas-duct 21 and/or because of the restrictor arranged near the opening 24, the purging gas flow remains low enough so that purging raises the vacuum pressure by only a small amount, for example by an amount between about 0.05 bar and 0.2 bar. As a result, during the purging operation, the internal pressure within the container 2 remains considerably below ambient pressure, for example around 0.15 bar to 0.45 bar below ambient pressure. To intensify purging, the supply of purging gas can be provided in a time-controlled manner and continuously. Alternatively the purging gas can be supplied at intervals, i.e. in a sequence of steps.

Figure 4:
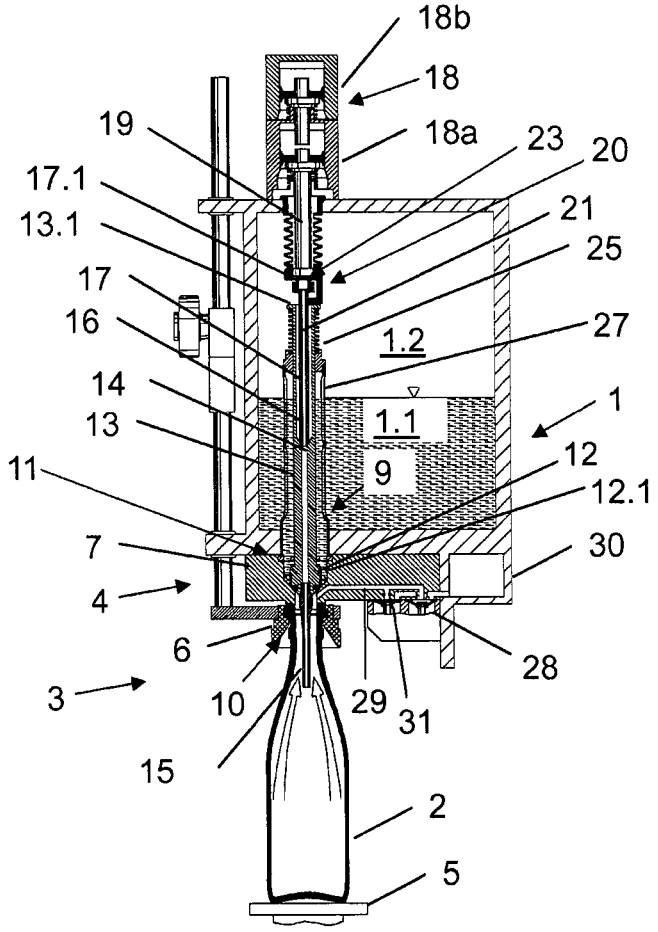
FIG. 4 shows a vertical section of the filling element as it evacuates a container.

As shown in FIG. 4, after the purging operation has ended by advancing the plunger 19 to a lower position, thereby closing the second gas-valve 23, the container's interior remains connected to the vacuum source 30 via the vacuum duct 29 and the vacuum control-valve 28. This allows the container 2 to be evacuated to the original vacuum before the purging operation commences. This further raises the efficiency of the purging operation.

Figure 5:
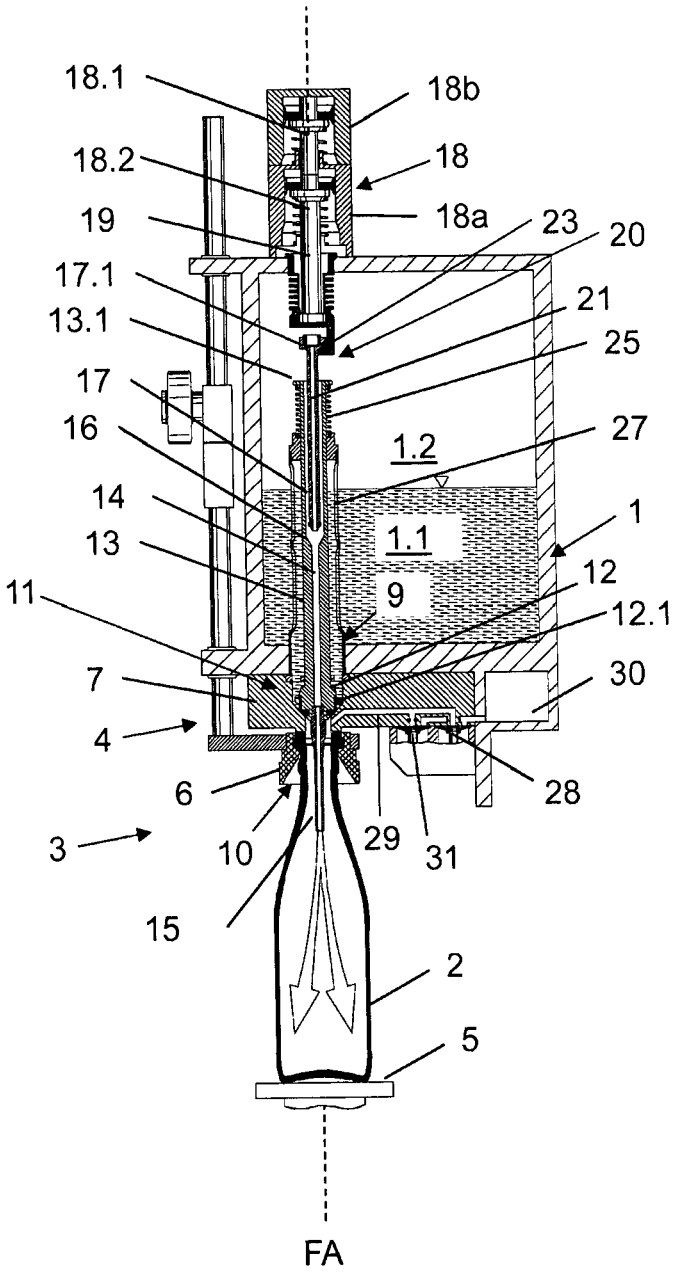
FIG. 5 shows a vertical section of the filling element as it pre-tensions a container.
Figure 6:
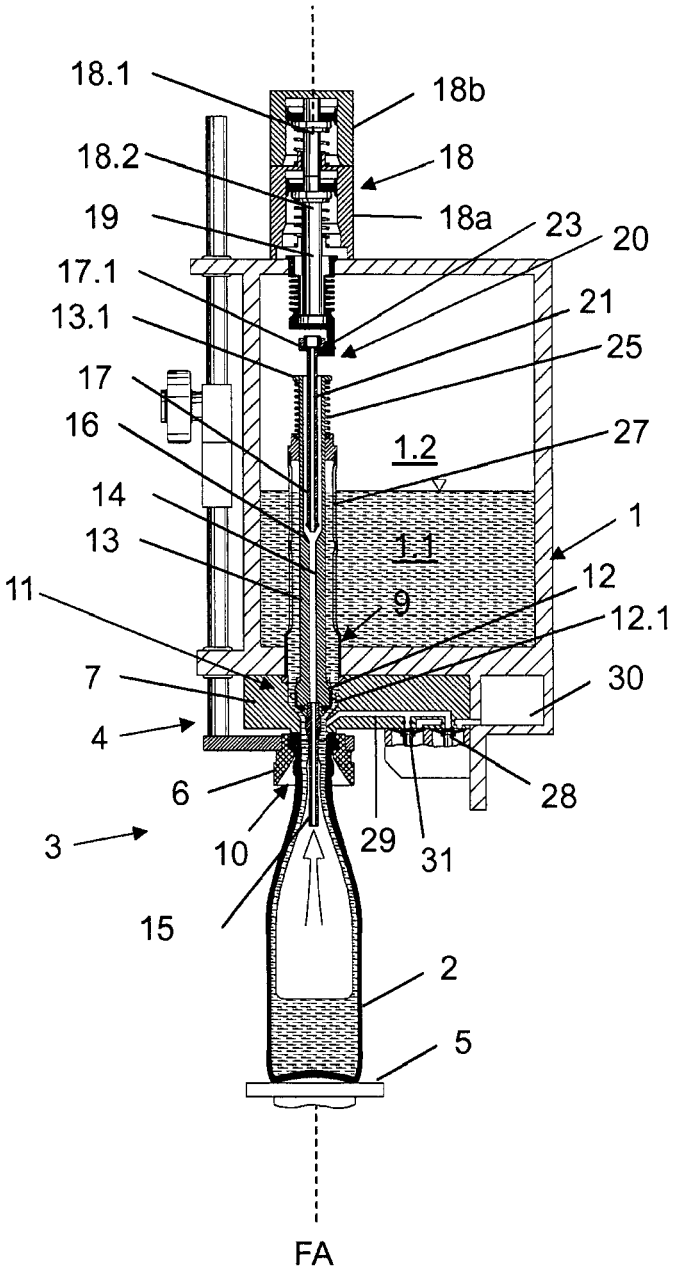
FIG. 6 shows a vertical section of the filling element as it fills a container.
Figure 7:
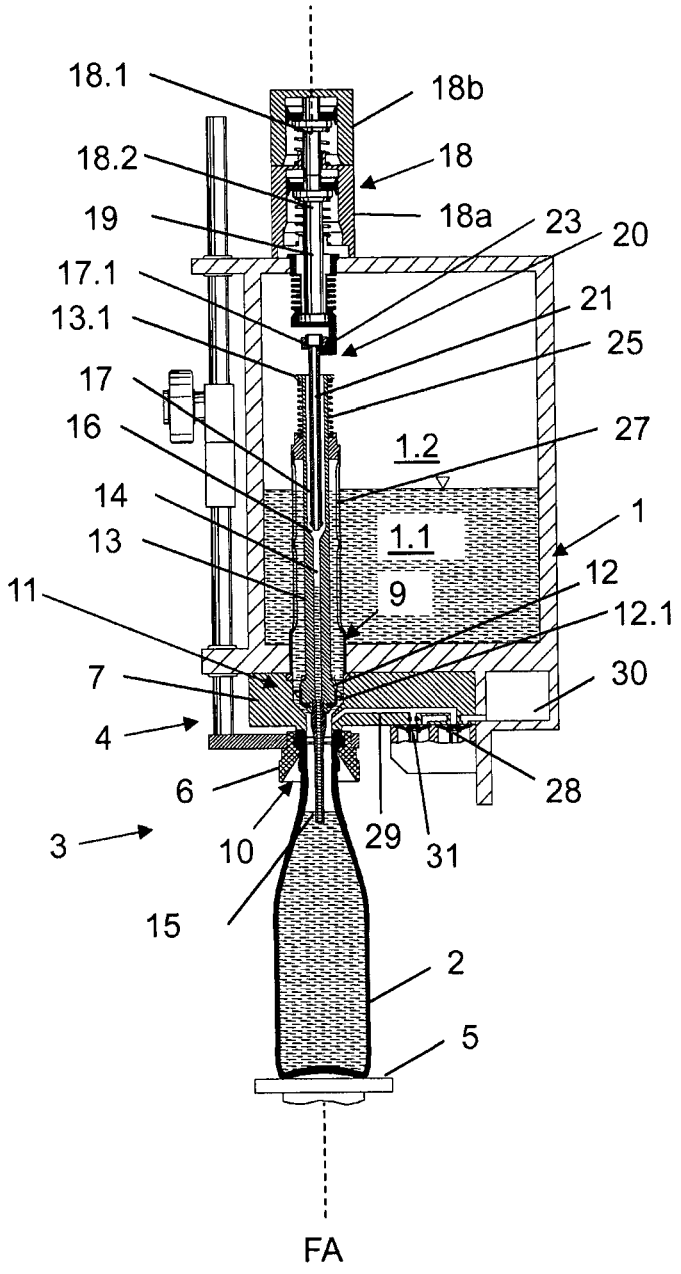
FIG. 7 shows a vertical section of the filling element upon completion of a filling operation.
Figure 8:
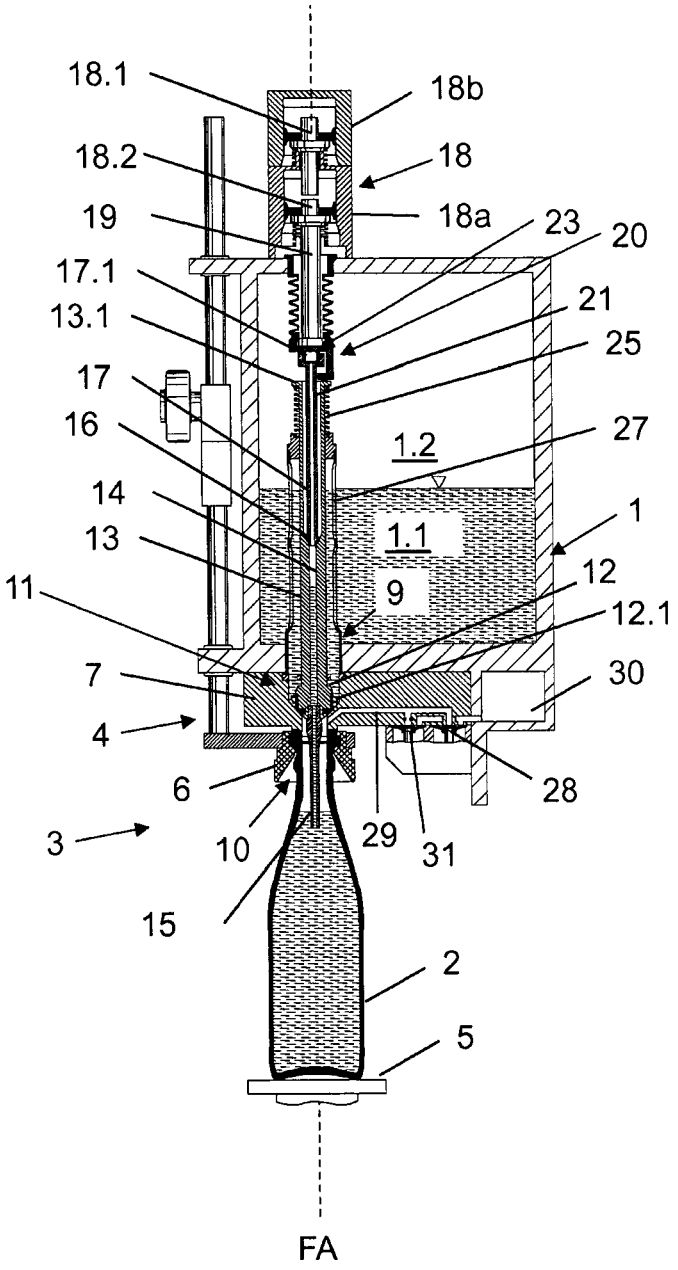
FIG. 8 shows a vertical section of the filling element with liquid valve closed.

To more quickly pre-tension a container 2 prior to filling it, the actuator 18 moves the piston rod of the upper piston-cylinder arrangement 18*b* into an upper position as shown in FIG. 5. This enables the piston rod of the lower piston-cylinder arrangement 18*b* to carry out a stroke having a length that is equal to the sum of the lengths of the lower partial-stroke H1 and the upper partial-stroke H2 and, in the process, to open the first gas-valve 16, which releases a considerably greater volumetric flow from the first gas-space 1.2 into the container's interior.

The spring 25 applies a spring force that is great enough to lift the liquid-valve body 12 up off its valve seat when the pressure in the container's interior is equal to the pressure in the vessel 1. As a result, liquid filling-product in the vessel 1 enters the container's interior through the liquid duct 8 and the product-dispensing opening 10. The inert gas that is used to pre-tension the container 2 then flows backs through the gas tube 15, through the first gas-duct 14, and through the open first gas-valve 16 on its way back to the first gas-space 1.2 of the vessel 1.

In some embodiments, the spring force is slightly greater than the weight of the liquid-valve body 12, the valve plunger 13, or the column of liquid of the product contained in vessel 1 acting on the liquid-valve body 12 less friction forces.

In some embodiments, a gas barrier 12.1 in a region immediately above a valve disk of the liquid-valve body 12 ensures that gas from the container's headspace will not pass beyond the liquid-valve body 12 and on into the liquid space 1.1 of the vessel 1.

The actuator 18 seals the liquid valve 11 using the valve plunger 13 to push the adapter 20 so that the pushing surface 20.3 of the hook 20*a* pushes against the plunger flange 13.1. In particular, as the piston rod of the lower piston-cylinder arrangement 18*a* returns to its lower initial position, the pushing surface 20.3 comes to rest against the plunger flange 13.1. In doing so the pushing surface 20.3 pushes the liquid-valve body 12 against the spring force of the spring 25 such that the liquid-valve body 12 rests in a fluid-tight manner against the filling-element housing 7. Resetting the plunger 19 closes both the first and second gas-valves 16, 23 again, thus separating the first and second gas-ducts 14, 21 from the first gas-space 1.2.

Figure 9:
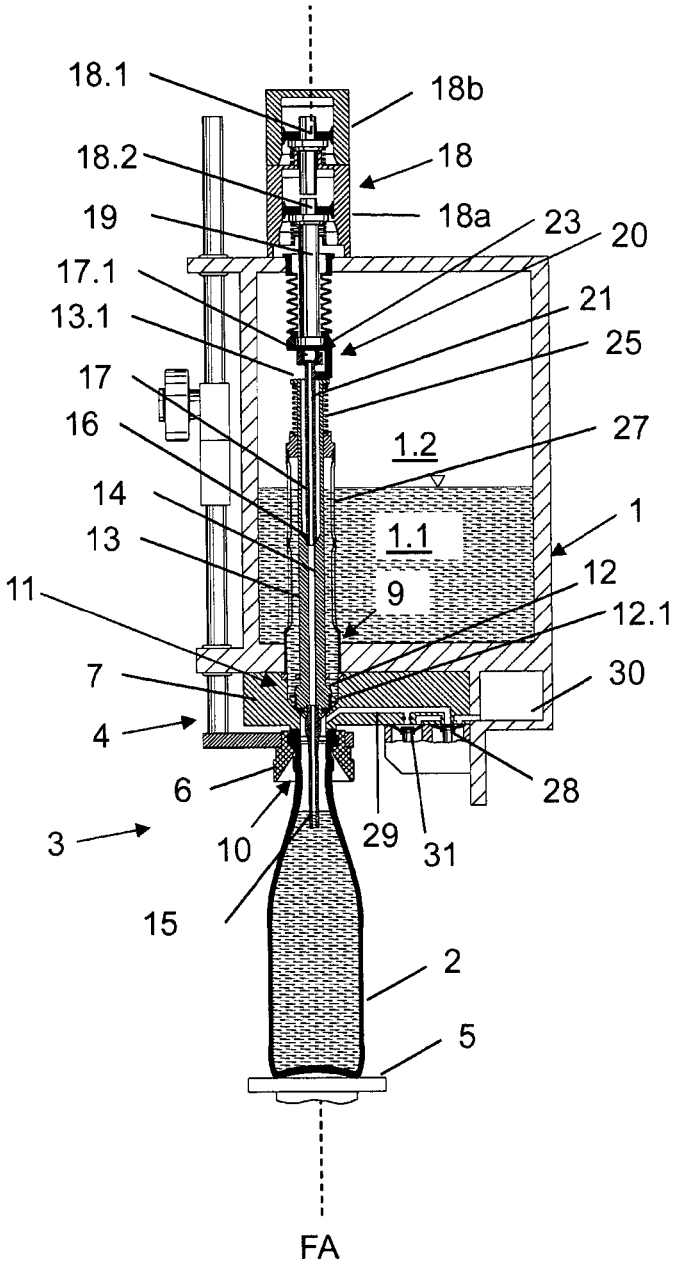

Referring now to FIG. 9, when the liquid valve 11 and the first and second gas-valves 16, 23 have closed, a depressurizing valve 31 connects the container's interior to ambient air via the vacuum duct 29, thus depressurizing the container's interior. This depressurizing can be carried out in stages with a plurality of depressurization steps and/or using a restrictor in the vacuum duct 29.

Upon completion of depressurization, the container carrier 5 lowers the container, thus breaking the seal between the container 2 and the filling element 4.

Figure 10:
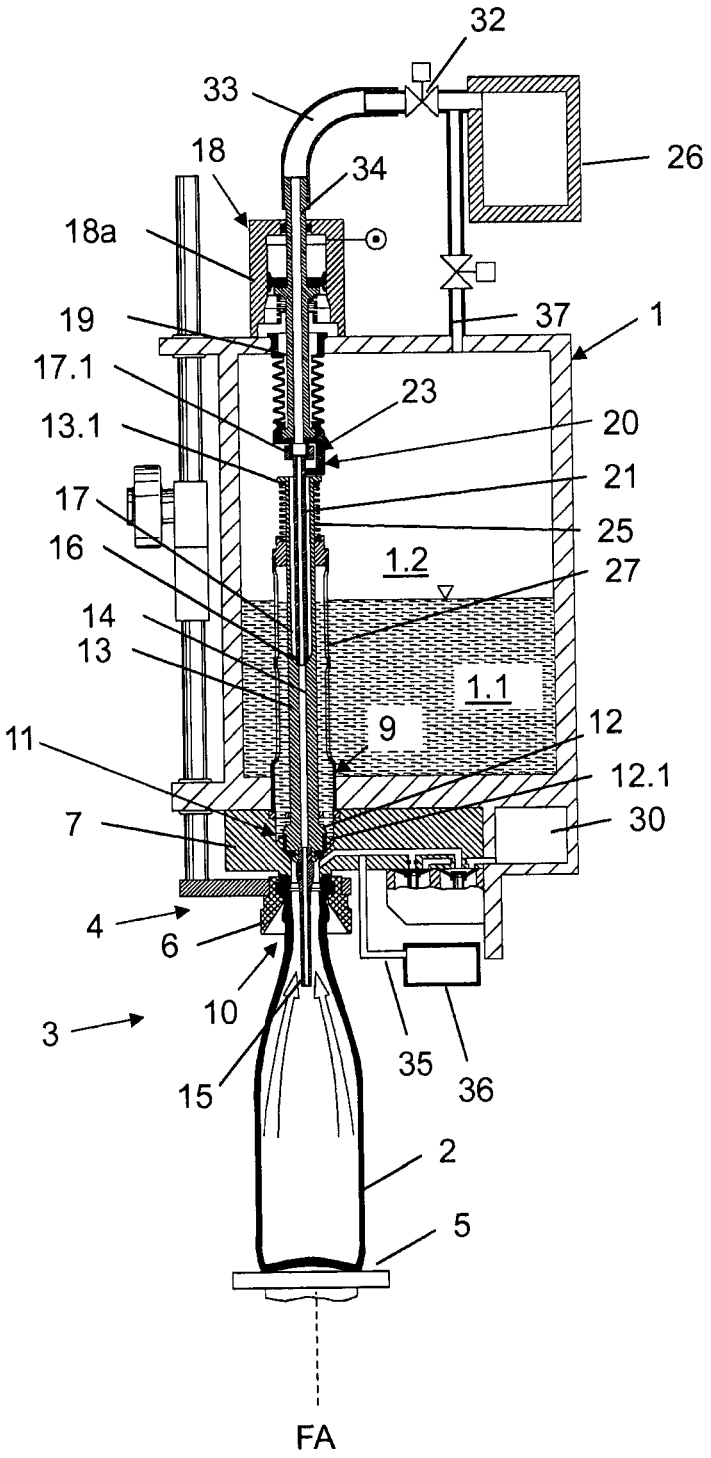
FIG. 10 shows a vertical section of a first alternative embodiment of the filling element.

FIG. 10 shows a first alternative embodiment of the filling system. The fundamental structure of the filling system is identical with the filling system structure described above, and so only the differences between the alternative embodiment and the previously described embodiment will now be explained.

In the embodiment of FIG. 10, the filling system comprises a second gas-space 26 that contains a gas different from the gas present in the first gas-space 1.2. Examples of suitable gases include nitrogen, a vaporous medium, carbon dioxide, or similar gases.

A third gas-valve 32 selectively connects the second gas-space 26 via a preferably flexible second-gas-space gas-line 33 with a third gas-duct 34 that extends through the piston rod of the actuator 18. The third gas-duct 34 passes through the piston rod longitudinally along the filling element axis FA.

At its lower end, the opening 24 connects the third gas-duct 34 to the second gas-duct 21 upon closing the second gas-valve 23, where the adapter surface 20.2 of the adapter 20 rests against the opening 24. This also closes the first gas-valve 16. As a result, a continuous gas channel extends from the second gas-space 26 to the container's interior. This continuous gas channel extends through the second-gas-space gas-line 33, the third gas-duct 34, the second gas-duct 21, the first gas-duct 14, and the gas tube 15 into the container's interior.

An advantage to the embodiment shown in FIG. 10 is that the type of gas stored in the second gas-space 26 can be different from the type gas stored in the first gas-space 1.2. In particular, the gas stored in the second gas-space 26, which is used only for pre-tensioning and is not used for extended storage with the filling product, can be a less expensive gas than the gas used in the first gas-space 1.2.

The actuator 18 can be configured to cause only a single-stage stroke in which the stroke's travel opens only the second gas-valve 23. This means that, during pre-tensioning, the first and second gas-valves 16, 23 will be closed. As a result, the only gas that makes it to the container's interior is the gas stored in the second gas-space 26. This results in a less expensive pre-tensioning procedure.

Some embodiments include a trinox gas space 36 that connects with the container's headspace via a trinox duct 35 coupled to the vacuum duct 29. This arrangement causes the product level of the filled container 2 to be level with the bottom end of the gas tube 15. In this embodiment, any filling-product that lies above the bottom end of the gas tube 15 is pushed through the gas tube 15 and all the way up to the second-gas-space gas-line 33 toward a connecting duct 37 that connects the second-gas-space gas-line 33 to the vessel 1. As a result, the excess filling-product is returned to the vessel 1 and used again to fill another container.

Figure 11:
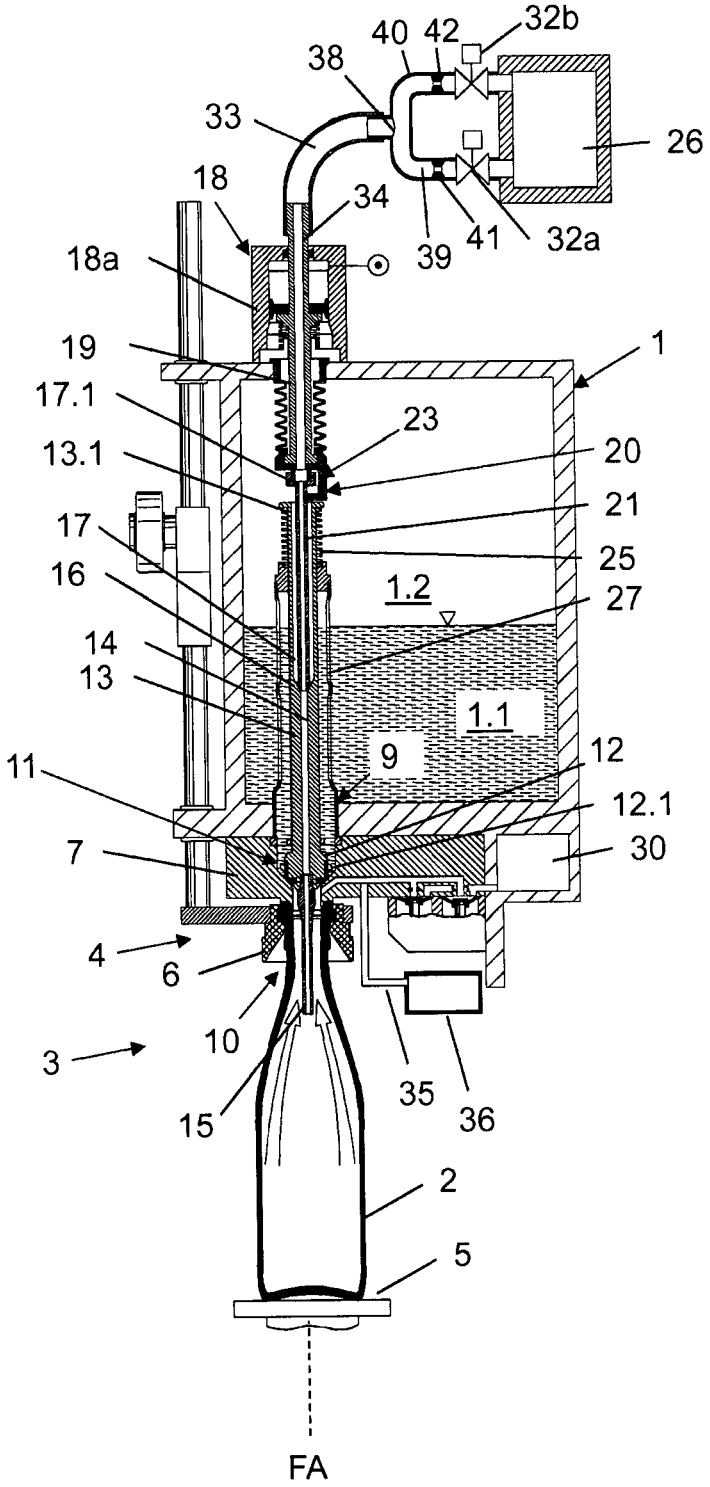
FIG. 11 shows a vertical section of a second alternative embodiment of the filling element.

Unlike the embodiment shown in FIG. 10, an alternative embodiment shown in FIG. 11 avoids having a restrictor in the region of second gas-duct 21 of the gas-valve body 17 to reduce the gas flow through the gas-valve body 17. Instead, the restrictor is moved outside into the region of the second-gas-space gas-line 33 that connects the third gas-duct 34 to the second gas-space 26.

Also unlike the embodiment shown in FIG. 10, the second-gas-space gas-line 33 of the embodiment shown in FIG. 11 connects to a branch point 38 that leads to parallel first and second branches 39, 40, both of which lead to the second gas-space 26. The first branch 39 guides its contents through a first-branch restrictor 41 and the second branch 40 guides its contents through a second-branch restrictor 42. A first-branch control-valve 32*a* in the first branch 39 and a second-branch control-valve 32*b* in the second branch 40 permit the first and second branches 39, 40 to be opened independently of each other.

The first-branch restrictor 41 and the second-branch restrictor 42 are dimensioned to cause different volumetric flow rates assuming constant pressure in the second gas-space 26. In one embodiment, the first-branch restrictor 41 has a smaller bore than the second-branch restrictor 42.

Depending on the nature of the purging method therefore, the volumetric flow through the third gas-duct 34 or through the second-gas-space gas-line 33 can be selected by choosing which one of the first-branch control-valve 32*a* and the second-branch control-valve 32*b* to open and which one to close.

The ability to control flow rate during the purging process represents a considerable advantage especially when containers that are to be filled at the filling element include those that are typically filled with vacuum assistance, such as glass bottles, and those that are typically filled without vacuum assistance, such as PET bottles. These applications are best carried out at different purging pressures. As a result, it becomes possible to choose the flow rate as a function of the purging pressure prevailing in the container to be filled.

The invention has been described hereinbefore by reference to a number of embodiments. It goes without saying that numerous variations as well as modifications are possible without departing from the inventive concept underlying the invention.

Having described the invention, and a preferred embodiment thereof, what is claimed as new, and secured by Letters Patent is:

1. An apparatus for filling containers with liquid product, said apparatus comprising a product vessel and a filling element arranged below said product vessel, wherein said filling element comprises a filling-element housing, a dispensing opening, an actuator, a liquid valve, a liquid duct, a valve plunger, a liquid valve body, a gas tube, a first gas-duct, a first gas-valve, a second gas-valve, a gas-valve body, a valve seat, a second gas-duct, a valve face, and a valve opening, wherein in operation, liquid product partially fills said product vessel, thus defining a liquid space occupied by said filling product and a first gas-space above said liquid space, wherein said filling-element housing comprises said liquid duct formed therein, said liquid duct connecting to said liquid space, wherein said dispensing opening is disposed on an underside of said filling-element housing, said underside facing away from said product vessel, wherein said liquid valve comprising said valve plunger and a liquid valve body, wherein said valve plunger is aligned coaxially with a filling-element axis, wherein said liquid-valve body is provided on said valve plunger, wherein said liquid-valve body is movable along said filling-element axis to open and close said liquid valve, wherein said gas tube is provided on said valve plunger, wherein said gas tube, in operation, extends into a head space of a container that is arranged to be filled at said filling element, wherein said valve plunger and said gas tube cooperate to define said first gas-duct, wherein said first gas-duct extends through said valve plunger and through said gas tube, wherein said first gas-duct has an upper end that extends into said first gas-space of said product vessel and a lower end that opens into an interior of said container, wherein said first gas-valve is disposed along said first gas-duct, wherein said first gas-valve comprises said gas-valve body, wherein said gas-valve body interacts with said valve seat, wherein said valve seat is configured in said first gas-duct, wherein said first gas-valve transitions between an open and closed state in response to said actuator, wherein said second gas-duct is formed through said gas-valve body, wherein said second gas-duct is configured to at least temporarily engage said first gas-duct in a fluid-tight manner, and wherein said gas-valve body comprises said valve face and said valve opening, wherein said valve face and said valve opening cooperate to form said second gas-valve, and wherein, when said second gas-valve opens, a flow of gas through said first and second gas-ducts enters said container.

2. The apparatus of claim 1, wherein said gas-valve body is configured as a hollow needle.

3. The apparatus of claim 1, wherein said first gas-duct has a first cross-section, wherein said second gas-duct has a second cross-section, and wherein said second cross-section is less than said first cross-section.

4. The apparatus of claim 1, further comprising a restrictor in said second gas-duct, wherein said restrictor is configured to reduce gas flow through said second gas-duct.

5. The apparatus of claim 1, wherein said actuator is configured to open or close said valve opening by execution of a first partial-stroke, a length of which is restricted by an obstruction to travel.

6. The apparatus of claim 1, wherein said gas-valve body is configured to be movable along said filling element axis for opening and closing of said first gas-valve, and wherein said gas-valve body and interacts with a valve face configured in said first gas-duct.

7. The apparatus of claim 6, wherein said actuator is configured to move said gas-valve body along a first partial-stroke and along a second partial-stroke, wherein stroke paths of said first and second partial-strokes are coaxial.

8. The apparatus of claim 1, wherein said first and second gas-valves are configured such that opening said first gas-valve causes a greater gas flow rate than opening said second gas-valve.

9. The apparatus of claim 1, wherein a part of a length of said gas-valve body of said first gas-valve is accommodated in said first gas-duct, wherein said gas-valve body comprises an upper end that projects out of said first gas-duct, wherein said upper end interacts said actuator.

10. The apparatus of claim 9, wherein said valve opening of said gas-valve body is provided on an upper end face of said gas-valve body, wherein said upper end face projects beyond said first gas-duct.

11. The apparatus of claim 1, further comprising a plunger and an adapter, wherein said actuator comprises first and second lifting-elements that are coaxial with said filling-element axis, wherein said first lifting-element acts through said plunger and said adaptor on said gas-valve body, wherein said second lifting-element forms a stop for a stroke of said first lifting-element, wherein said second lifting element transitions between first and second states, wherein, in said first state, said stroke is limited to a first partial-stroke, wherein, in said second state, said second lifting-element is raised by a second partial-stroke such that said stroke of said first lifting-element has a length that is increased to increased to a sum of said first and second partial strokes.

12. The apparatus of claim 11, wherein said adapter brings about a sealing of said opening, wherein said adapter causes closing of said second gas-valve when said first lifting element is in a lowered state.

13. The apparatus of claim 11, wherein, when said first lifting element is in a raised state, said adapter is lifted off said opening, and said second gas-valve opens.

14. The apparatus of claim 11, wherein said adapter comprises a hooking surface, wherein during said first partial-stroke, said hooking surface remains separated from said gas-valve body, wherein during said second partial-stroke, said hooking surface engages said gas-valve body so as to raise said gas-valve body out of said sealed position of said valve face configured in said first gas-duct.

15. The apparatus of claim 11, wherein said adapter comprises an adapter surface that interacts with said valve plunger for closing said liquid valve.

16. The apparatus of claim 1, further comprising a spring, wherein said spring is configured to pre-tension said liquid valve into an open state thereof.

17. The apparatus of claim 1, further comprising a second gas-space, wherein said second gas-duct second gas-duct connects at least temporarily to said second gas space, wherein said second gas space is independent of said first gas-space.

18. The apparatus of claim 17, wherein said second gas-duct is configured to transition between a first state for purging said container and a second state for pre-tensioning said container, wherein, in said first state, said second gas-duct connects to said said first gas-space, and wherein, in said second state, said second gas-duct connects to said second gas space.

19. A method for treating a container with a gas prior to filling said container using a filling element against which said container is sealed during treatment, through which gas is introduced into said container, and through which gas displaced from said container passes through, said filling element comprising a first gas-duct that opens, at an upper end thereof, into a gas-space of a product vessel and that opens, at a lower end thereof, into a head space of said container, said first gas-duct having a gas-valve body that is movable to open and close a first gas-valve and in which a second gas-duct is configured, said second gas-duct being connected at least temporarily with said first gas-duct in a fluid-tight manner, said method comprising before pre-tensioning said container with a first process gas stored in said gas space, evacuating said container with a vacuum provided by a vacuum source, opening a first gas-valve to pre-tension said container with said first process gas, said first process gas flowing at a pre-tensioning volumetric flow rate, and with said container still connected to said vacuum source, opening a second gas-valve to introduce a second process gas for purging said container through said second gas-duct, said second process gas flowing at a purging volumetric flow rate, wherein said purging volumetric flow rate is less than said pre-tensioning volumetric flow rate.

20. The method of claim 19, wherein said first process gas and said second process gas are the same gas.

21. The method of claim 20, further comprising selecting said purging volumetric flow rate and said vacuum such that when said second process-gas flows into said container's interior, said interior is maintained at a purging pressure that is within a pre-set tolerance around ambient pressure.

22. The method of any one of claim 21, said purging pressure is within 0.1 bar and 0.45 bar of ambient pressure.

23. The method of claim 19, wherein evacuating said container comprises evacuating to a pressure ranging between 0.05 bar and 0.2 bar in a first process step, and in a second, subsequent process step introducing said second process gas into said container in such a way that pressure in said container increases by less 0.2 bar.

24. The method of any one of claim 19, further comprising passing said second process gas through a restrictor provided in said second gas-duct.

25. The method of claim 24 wherein said restrictor comprises a bore with a diameter of 0.3-1 mm for a restrictor length in said direction of flow of said gas of 0.5 mm.

26. The method of claim 19, wherein opening a second gas-valve comprises causing an actuator to execute a first partial-stroke that results in an interaction said gas-valve body.

27. The method of claim 19, wherein opening a first gas-valve to pre-tension said container with said first process gas comprises causing an actuator to move said gas-valve body.

* * * * *